United States Patent [19]

Ward

[11] 3,958,719

[45] May 25, 1976

[54] RELATING TO CONTAINERS

[76] Inventor: Dennis H. Ward, 1 Garvock Drive, Kippington Road, Sevenoaks, Kent, England

[22] Filed: Nov. 30, 1972

[21] Appl. No.: 310,899

[30] Foreign Application Priority Data

Dec. 16, 1971 United Kingdom ..... 58474/71

[52] U.S. Cl. ..... 220/288; 285/202; 285/204; 284/DIG. 22

[51] Int. Cl.[2] ..... B65D 41/04

[58] Field of Search ..... 217/109; 285/201, 202, 285/203, 204, DIG. 22; 220/39, 45, 46

[56] References Cited

UNITED STATES PATENTS

| | | | |
|---|---|---|---|
| 698,217 | 4/1902 | Newton | 285/202 |
| 1,538,007 | 5/1925 | Schellin | 285/DIG. 22 |
| 1,709,324 | 4/1929 | Runser | 285/202 |
| 1,789,928 | 1/1931 | Wackman | 285/202 |
| 1,974,968 | 9/1934 | Meek | 285/202 |
| 2,008,245 | 7/1935 | Curtis | 285/204 |
| 2,062,780 | 12/1936 | Curtis | 285/202 |
| 2,103,838 | 12/1937 | Bach | 285/DIG. 22 |
| 2,122,054 | 6/1938 | Curtis | 285/204 |
| 2,182,954 | 12/1939 | Wackman | 220/39 B |
| 2,369,895 | 2/1945 | Hanrahan | 285/203 |
| 2,471,716 | 5/1949 | Bell | 285/204 |
| 2,784,865 | 3/1957 | Rieke | 285/201 |
| 2,786,643 | 3/1957 | Carlstedt | 285/201 |
| 3,026,130 | 3/1962 | Morrell | 285/201 |
| 3,061,338 | 10/1962 | Clark | 285/202 |
| 3,080,182 | 3/1963 | Waldo | 285/204 |
| 3,099,364 | 7/1963 | Todd | 220/24.5 |
| 3,337,083 | 8/1967 | Godshalk | 220/39 R |
| 3,393,823 | 7/1968 | Dearing | 220/39 B |
| 3,424,481 | 1/1969 | Fulchum | 285/203 |
| 3,506,286 | 4/1970 | Defauw | 285/203 |
| 3,640,552 | 2/1972 | Demler | 285/DIG. 22 |
| 3,645,547 | 2/1972 | Glover | 285/DIG. 22 |

FOREIGN PATENTS OR APPLICATIONS

| | | | |
|---|---|---|---|
| 768,497 | 2/1934 | France | 285/203 |
| 1,384,638 | 9/1963 | France | 285/DIG. 22 |
| 1,473,122 | 12/1966 | France | 285/DIG. 22 |
| 1,220,249 | 1/1971 | United Kingdom | 285/DIG. 22 |

*Primary Examiner*—Ro E. Hart

*Attorney, Agent, or Firm*—Baldwin, Wight & Brown

[57] ABSTRACT

A container for fluids which is closed by a cap which is inserted into the neck of the container. A coupling member is interposed between the neck and the cap which is fitted to the container after it has been formed. The coupling member is readily attachable to the container from its exterior without requiring any modification to the container and has a central bore to receive the cap.

12 Claims, 3 Drawing Figures

RELATING TO CONTAINERS

Figure 1:
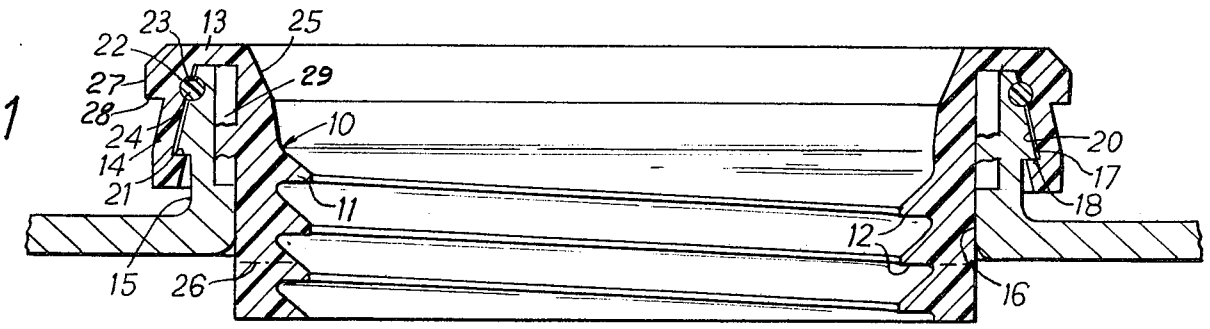

This invention relates to containers for fluids and is more particularly concerned with facilitating the fabrication of such containers.

Drums and similar containers, particularly those of larger capacities and made of plastics material are normally fitted with bungs in the filling necks of the container.

The filling necks of the container are formed integrally with the container and have to be accurately made to receive these bungs in order that the container will be fluid tight. This presents a number of difficulties as well as adding to the problems of manufacturing and can be the cause of mal-formed necks which means that a larger container otherwise satisfactory has to be scrapped. It is an object of the present invention to overcome these drawbacks.

According to the present invention a coupling member for the neck of the container has means for connecting it to the container from the exterior thereof and means adapted to receive a bung. Thus the member can be manufactured separately and accurately formed to receive the bung and connected to the container after it has been manufactured and without having to alter the container in any way and which does not require access to the interior of the container to provide a retention element for the coupling member. As mentioned above this is particularly advantageous with plastics containers where the material for the insert and the container are the same.

Preferably the member comprises a sleeve portion adapted to be inserted in the neck of the container, and the means adapted to receive the bung may comprise a screwthreaded bore adapted to receive a screwthreaded bung. In this case the screwthreaded bore may be formed on the interior of the sleeve portion.

Means are preferably also included for sealing the member with respect to the interior of the container so that where a fluid tight seal is made with the bung and the member, the member will also be sealed with respect to the interior of the container.

Whilst the member may be coupled to the container by any convenient method such as welding it is conveniently arranged to be a press fit on the neck of the container. To this end the sleeve portion may have a annular portion of channel section adapted to fit over the neck of the container and in this case the annular portion may have an undercut adapted to co-operate with a protrusion on the neck to retain the member on the neck, and the protrusion and undercut may either be radiussed or sharp edged.

Where the member is sealed with respect to the neck preferably the member and the neck are provided with cooperating grooves housing an O ring seal adapted to seal the neck with respect to the member. The grooves are conveniently formed between the outside of the neck and the annular channel section member. In an alternative arrangement the seal may be in the form of a gasket in the base of the channel section and engaging the top of the neck.

In one arrangement the sleeve may extend into the neck below the level of the base of the neck and in this case openings may be provided in the sleeve below the level of the neck to allow free passage of fluid. With this arrangement it is possible to provide a longer length of thread whilst requiring a very small projection of the neck proper above the outer surface of the container. This also obviates the necessity for making the neck of sufficient length to accommodate any extra length thread required which would otherwise have to be moulded into the neck of the container itself and the neck height increased accordingly. Moreover, in many applications a very low neck height is advantageous, for example, in the case of a large capacity industrial drum the contours of the drum being formed so as to provide protection for the neck and the bung. With the present invention the neck can be moulded to a shorter height and the protective contours correspondingly reduced which in turn facilitates the manufacture of the container itself. Moreover, with this arrangement if despite this extra protection the neck sealing faces still are damaged the insert may be removed and a fresh one fitted thus saving the cost of a new container.

Preferably also means are provided for preventing rotation of the member with respect to the neck, and in this case the means may comprise one or more keys located in keyways. Co-operating lugs may be provided on the container and coupling member adapted to prevent rotation and/or be welded to one another to deter pilferage.

Moreover, the member may be provided with means for receiving an overcap such as may be used to seal the container against pilferage.

According to another feature of the invention is the combination of a container and a coupling member as set forth.

The invention may be performed in various ways and two specific embodiments will now be described by way of example with reference to the accompanying drawings, in which, FIG. 1 is a cross-section through the neck of a container and one form of coupling member according to the present invention.

Figure 2:
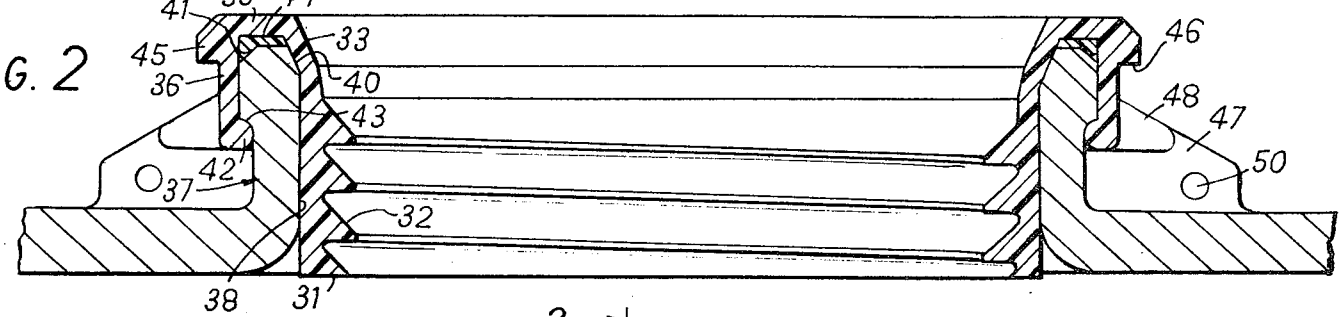
Figure 3:
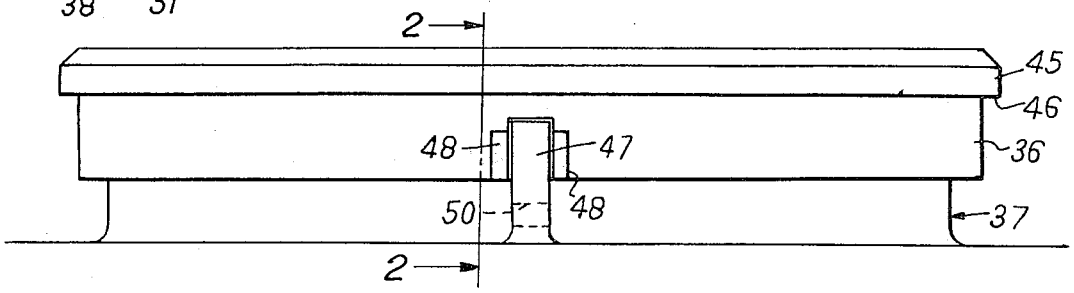

FIG. 2 is a similar view taken on the line 2—2 of FIG. 3 of a modified form of the invention, and, FIG. 3 is an end view of FIG. 2.

In the arrangement shown in FIG. 1 the coupling member is indicated generally at 10 and comprises a sleeve 11 the interior of which is provided with screwthreads 12. The sleeve 11 is formed integrally at its upper end with a flange 13 connecting it integrally with a flange 14 directed generally parallel to the sleeve 11, the flanges 13 and 14 forming with the upper portion of the sleeve 11 a generally annular channel section ring.

The container neck is indicated generally at 15 and has a smooth internal bore 16 engaging the external periphery of the sleeve portion 11 and an exterior taper 17 providing an overhang 18, the taper 17 and overhang 18 being arranged to co-operate respectively with a similarly formed socket 20 on the sleeve 14 and an undercut 21 which engages under the overhang 18.

Adjacent the upper end of the sleeve 14 on the socket 20 is an annular groove 22 co-operating with a second annular groove 23 in the neck of the container and housing an O ring 24 which is arranged to be compressed to provide a seal between the coupling member and the container neck.

The upper end of the sleeve 11 is chamfered at 25 to provide a seating for a conventional bung (not shown).

In some arrangements the sleeve 11 may extend below the level of the base of the neck and in this case openings or draining slots 26 may be provided in the sleeve.

A further flange coupled to the flange 13 may be provided at 27 to provide a shoulder 28 upon which an overcap can be received.

In order to prevent any rotation of the insert with respect to the neck keys 29 are provided on the coupling member engaging in appropriate keyways 29a in the neck.

An alternative construction is shown in FIGS. 2 and 3. In this construction the coupling member comprises a sleeve 31 similar to the sleeve 11 and the interior of which is formed with screwthreads 32, the upper end of the sleeve being chamfered at 33, again to provide a seating for a conventional bung. The internal surface of the member is similarly inclined to the chamfer at 34 as the container neck is itself chamfered in this construction.

Integrally formed with the sleeve at its upper end is a flange 35 which is in turn integrally formed with the flange 36 arranged parallel to the sleeve 31 again to provide a generally annular channel section ring.

The neck of the container is indicated generally at 37 and has a smooth internal bore 38 engaging the sleeve 31. The upper end of the neck is chamfered at 40 to engage the internal inclined portion 34 on the coupling member. The outer wall of the neck is chamfered at 41 and then has a portion concentric with the inner bore 38, and is then provided with a radiussed overhang 42. The coupling member has a similarly radiussed undercut 43 adapted to engage under the overhang 42. A gasket 44 is interposed between the top of the neck and the base of the channel section of the U to provide a seal between the coupling member and the container neck. The gasket may conveniently be of the kind which is permanently secured to the inside of the coupling member and may be formed of neoprene. The coupling member is also provided with an additional flange 45 providing a shoulder 46 upon which an overcap can be received.

In addition in this construction the container top is formed with two diametrically opposed lugs 47 welded to it. The coupling member is provided on each side with a pair of lugs 48 which are adapted to extend on each side of and embrace the lugs 47. The lugs on the container and the lugs on the coupling member can be welded to one another e.g. by heating or by ultra sonics. These lugs make it difficult to interfere with the neck of the container without detection, thus deterring pilferage. In addition, holes 50 for securing labels or for wiring of security seals are provided in the lugs 47.

In this arrangement the lugs prevent rotation of the coupling member with respect to the container neck, but in another construction these could be removed and replaced by a key and keyway similar to that shown in FIG. 1. Moreover, the arrangement shown in FIG. 1 could be modified to provide it with lugs instead of the key and keyway. In a further alternative construction both the key and keyway and the lugs could be used together.

In both constructions the inserts and the container are normally formed of plastics material so that the coupling member is a press fit onto the container. However, it could also be secured by welding, i.e. the coupling member is itself welded to the container without the aid of the lugs.

Moreover, the sleeve 31 may be similarly elongated as the sleeve 11 is in the construction of FIG. 1 in order to provide extra length for receiving the bung.

I claim:

1. A coupling member for an outwardly projecting neck of a container wherein the container neck terminates in an outer free edge, said coupling member comprising a sleeve adapted to be inserted into the container neck, securing means of the snap locking type engageable over an outwardly projecting container neck for releasable securing the sleeve to the neck, sealing means automatically engageable when the sleeve is inserted into the neck for sealing the sleeve with respect to the neck, the sleeve having an internal screw thread adapted to engage a screw threaded bung used to close the container neck, and locking means for locking the sleeve with respect to the container neck to prevent relative rotation.

2. A coupling member for the neck of a container as claimed in claim 1 in which the securing means includes an annular means of channel section for fitting over the neck of the container, and the locking means includes an axial key on the exterior of said sleeve projecting radially into the channel of said channel section, and a cooperating axially extending radially opening keyway on the interior of the container neck.

3. A coupling member for the neck of a container as claimed in claim 1 in which the securing means includes an annular means of channel section for fitting over the neck of the container, and the locking means includes at least one axially extending and radially projecting rib on the exterior of the container neck, a notch in said annular means for telescoping over said rib, and a lug on said annular means adjacent said notch for welding to said rib.

4. A coupling member for the neck of a container as claimed in claim 1 in which the sealing means includes the coupling member and the neck being provided with co-operating grooves housing an O ring.

5. A coupling member for the neck of a container as claimed in claim 1 in which the securing means includes an annular means of channel section for fitting over the neck of the container, and the sealing means is in the form of a gasket in the base of the channel section annular means and engaging the top of the neck.

6. A coupling member for the neck of a container as claimed in claim 1 which said locking means includes cooperating lugs on the container and notches on the coupling member for preventing rotation of the container and said coupling member relative to one another.

7. A coupling member for the neck of a container as claimed in claim 1 including means on the coupling member to directly receive an overcap in releasable interlocked relation.

8. A coupling member for the neck of a container as claimed in claim 1 in which the coupling member is formed of a resilient plastics material.

9. A coupling member for the neck of a container as claimed in claim 1 in which the coupling member is dimensional to have a press fit on the neck of the container.

10. A coupling member for the neck of a container as claimed in claim 9 in which the securing means includes an annular means of channel section for fitting over the neck of the container.

11. A coupling member for the neck of a container as claimed in claim 10 in which the annular means has undercut means for cooperation with a protrusion on the neck to retain the member in the neck.

12. A coupling member for the neck of a container as claimed in claim 11 in which the protrusion and undercut are complementarily shaped.

* * * * *